US008240184B2

(12) United States Patent
Flehmig et al.

(10) Patent No.: US 8,240,184 B2
(45) Date of Patent: Aug. 14, 2012

(54) METHOD FOR PRODUCING HIGH-PRECISION HALF SHELLS

(75) Inventors: Thomas Flehmig, Ratingen (DE); Konstantinos Savvas, Oberhausen (DE)

(73) Assignee: ThyssenKrupp Steel AG, Duisburg (DE)

( * ) Notice: Subject to any disclaimer, the term of this patent is extended or adjusted under 35 U.S.C. 154(b) by 483 days.

(21) Appl. No.: 12/418,957

(22) Filed: Apr. 6, 2009

(65) Prior Publication Data

US 2009/0255317 A1 Oct. 15, 2009

(30) Foreign Application Priority Data

Apr. 11, 2008 (DE) ..... 10 2008 018 656

(51) Int. Cl.
*B21D 22/00* (2006.01)
*B21D 31/00* (2006.01)

(52) U.S. Cl. ..... 72/348; 72/379.2

(58) Field of Classification Search ..... 72/347, 72/348, 350; 428/603, 604
See application file for complete search history.

(56) References Cited

U.S. PATENT DOCUMENTS

| | | | | | |
|---|---|---|---|---|---|
| 662,567 | A * | 11/1900 | Von Lipowska | 428/604 |
| 1,499,985 | A * | 7/1924 | Kirsch | 428/595 |
| 1,499,986 | A * | 7/1924 | Kirsch | 428/595 |
| 1,807,141 | A * | 5/1931 | Wood | 72/197 |
| 1,823,802 | A * | 9/1931 | Humphris | 428/578 |
| 1,856,898 | A * | 5/1932 | Wood | 72/197 |
| 2,112,653 | A * | 3/1938 | MacLennan | 72/348 |
| 2,214,237 | A * | 9/1940 | Stark et al. | 428/7 |
| 2,251,477 | A * | 8/1941 | Wisman | 264/292 |
| 2,405,778 | A * | 8/1946 | Crawford | 72/472 |
| 5,174,146 | A * | 12/1992 | Heurteboust et al. | 72/348 |
| 5,532,051 | A * | 7/1996 | Nishiura et al. | 428/217 |
| 5,722,282 | A * | 3/1998 | Mine et al. | 72/348 |
| 6,082,166 | A * | 7/2000 | Marin | 72/348 |
| 6,205,831 | B1 * | 3/2001 | Adey et al. | 72/47 |
| 6,745,609 | B2 * | 6/2004 | Garnett et al. | 72/350 |
| 7,234,336 | B2 * | 6/2007 | Braun et al. | 72/379.6 |
| 7,340,934 | B2 * | 3/2008 | Kurokawa et al. | 72/350 |
| 7,490,503 | B1 * | 2/2009 | Kanemitsu et al. | 72/379.2 |
| 7,624,611 | B2 * | 12/2009 | Saitou | 72/349 |
| 2004/0083786 | A1 * | 5/2004 | Garnett et al. | 72/348 |
| 2007/0000298 | A1 * | 1/2007 | Braun et al. | 72/379.2 |

FOREIGN PATENT DOCUMENTS

| | | | |
|---|---|---|---|
| CA | 2 548 271 | A1 | 6/2005 |
| CA | 2548271 | A1 * | 6/2005 |
| DE | 197 42 818 | A1 | 4/1999 |
| WO | WO 2005053871 | A1 * | 6/2005 |

* cited by examiner

*Primary Examiner* — Edward Tolan
*Assistant Examiner* — Lawrence J Averick
(74) *Attorney, Agent, or Firm* — Proskauer Rose LLP

(57) ABSTRACT

A method for converting blanks by drawing in a tool with a ram, a die and a pressure pad wherein, converted blanks with high dimensional precision can be produced, includes feeding a blank with a plurality of bulges to the tool. In flange regions of the blank the pressure pad is moved in a first process step of the method into a first position, which corresponds to the height of the bulges of the flange region of the blank added to the blank thickness. In the first process step the blank is preformed in the tool using the ram and in a second process step the pressure pad and the ram are moved into the end positions, so that the blank is converted by the ram to the end form and the pressure pad smoothes the bulges of the flange regions of the blank.

10 Claims, 3 Drawing Sheets

METHOD FOR PRODUCING HIGH-PRECISION HALF SHELLS

CROSS-REFERENCE TO RELATED APPLICATIONS

This application which claims the benefit of and priority to German patent application no. DE 10 2008 018 656.2-14, filed on Apr. 11, 2008. The disclosure of the above application is incorporated herein by reference in its entirety.

FIELD OF THE INVENTION

The invention relates to a method for converting blanks by drawing in a tool with a ram, a die and a pressure pad.

BACKGROUND

The dimensional precision of half shell parts, which are fabricated by drawing a blank, is regularly subject to quality problems in production. High demands in dimensional precision are set particularly in automotive engineering, since the half shell parts must frequently mate with other components or half shell parts or be joined to these. The dimensional precision of converted blanks is substantially affected by the fact that stresses are induced in the blanks by shaping processes, which becomes apparent after conversion due to springback of the converted blank. This substantially reduces the dimensional precision of the converted blank and renders the production process for high precision components considerably more difficult. Up to now this problem has been solved by a preform being produced in order to convert this in a further tool to the end form. By the intermediate step of producing a preform, on the one hand, the strains induced by the shaping step are not so great. On the other hand, however, relatively high costs arise due to the intermediate step of producing an intermediate form. Above all, the material-shaping tools for the preform, but also the increase in production times, as a result of two separate working steps, lead to a cost burden on the total process until the finished component is produced.

German Patent Application DE 197 42 818 A1 discloses the production of a structural member for motor vehicles, having a reinforcing plate, which by deepenings and projections creates a shaping reserve for forming the base plate and the reinforcing plate. The reinforcing plate provided with projections and deepenings is intended to prevent the formation of wrinkles or tears during common shaping with the base plate. The German Patent Application mentioned is concerned with the shaping of reinforced or "patched" blanks. Although, for the reinforcing plate, tears and formation of wrinkles can be prevented during conversion by creating shaping reserves in the form of bulges, the dimensional precision of the converted blank outside the reinforced region is not improved.

European Patent EP 1 708 832 B1 discloses hydro-forming of a blank with bulges and/or deepenings, wherein the maximum natural strain is to be increased by the bulges/deepenings. Hydro-forming is only applicable in combination with closed hollow profiles. Therefore, no half shells are produced with this process. In addition, the working-media based forming is very time-consuming and relatively expensive compared to conventional deep-drawing.

SUMMARY OF THE INVENTION

In general, an aspect of the present invention is to provide a method for converting blanks by drawing in a tool with a ram, a die and a pressure pad, with which converted blanks with high dimensional precision can be produced, which due to their high dimensional precision can be used particularly well in automotive engineering.

In accordance with a first embodiment of the present invention, the aspect indicated above for the method is achieved in that a blank with a plurality of brought-in bulges is fed to a tool, for example a die, in the flange regions of the blank the pressure pad is moved in a first process step into a first position, which corresponds to the height of the bulges of the flange regions of the blank added to the blank thickness, the pressure pad holds the flange regions of the blank down in this position, in the first process step the blank is preformed in the tool using the ram and in a second process step the pressure pad and the ram are moved into the end positions, so that the blank is converted by the ram to the end form and the pressure pad smoothes the bulges of the flange regions of the blank.

It turns out that by the method according to the invention, when converting blanks, shaping reserves can be provided and during conversion the blank can be compressed over its entire cross sectional length. As a result of the improved shaping reserves, due to the provision of material in the bulges, larger natural strains are attainable during the drawing process. Existing stresses can be aligned by compressing the blank over its entire cross sectional length. This leads to components with particular high dimensional precision, since springback or back-forming of the components then takes place mainly in one direction. In the first process step the shaping reserve is utilized according to the invention particularly in the transitional areas between ram and drawing radius, which are provided by the bulges. In the second process step, which rather corresponds to pressing, the bulges and thus the semi-finished component is then compressed over its entire cross-sectional area. Both process steps preferably take place in the same tool, for example in the same die, so that compared to the prior art preforms, substantial cost savings are rendered possible and at the same time components with high dimensional precision can be provided.

An advantage of the method according to the invention is particularly pronounced in the production of half-shell components, that is to say components, which are frequently affected by strong springback with the conventional production method. The method according to the invention leads to a substantial reduction in springback and thus to a substantial increase in the dimensional precision of the half shells.

In accordance with an embodiment of the present invention during the first process step the bulges persist in the preformed blank and in the second process step first the pressure pad and afterwards the ram are moved into the end positions, so that the bulges are smoothed first in the region of the pressure pad and then in the remaining region. As a result, the stresses in the drawn component can be aligned in a particularly good and process-sure manner.

Preferably, according to a further embodiment of the present invention the blanks consist of steel or a high or maximum strength steel alloy. Converted components from steel or steel alloys are particularly prone to problems regarding dimensional precision as a result of springback, so that the method according to the invention is particularly advantageous in the case of these materials. High and maximum strength steel alloys offer the advantage of providing particularly small wall thicknesses with constant strength, so that weight savings are possible.

Preferably, in accordance with another embodiment of the method according to the invention all bulges of the blank are smoothed at the end of the drawing process, so that the maximum shaping reserve of the blank is utilized and at the same time a reduction in springback results.

If in the first process step the bulges are flattened in the inlet regions between flange and notches, particularly high natural strains of the drawing radius are possible due to the material which is additionally available.

If the ram of the tool has an extension towards the drawing radius, which produces the drawing radius on the component, undesirable corner formation in the second process step can be prevented.

If the bulges are to be preferably maintained in the notch region, a drawing gap is created between blank and tool which is greater than or equal to the height of the bulges added to the blank thickness. This is particularly necessary if essentially vertical notches are to be produced while maintaining the bulge structure.

If the drawing gap between blank and tool is approximately zero, all bulges of the blank can be smoothed in the second process step.

A compromise between good shaping reserve, simple forming capacity and optimized flow of material can be achieved in that according to another refined embodiment of the method according to the invention, the surface of the blank provided with bulges is 0.1-10% greater than that of an even blank.

Preferably, burls with a circular, elliptical, multi-angular and/or elongated opening surface are provided as bulges, which can be arranged on one side or on two sides. These can be simply created in processes prior to the production of the blanks, for example by band-wise embossing using rollers.

In order to prevent irregular distribution of the shaping reserves of the blank during conversion, the bulges on the blank are arranged in such a manner that equally distributed, even spacings develop on the blank between the bulges. This is particularly important if for example bulges with elliptical and/or elongated opening surfaces are used.

In accordance with another aspect of the present invention a blank converted with the method described above is utilized as a structural member, particularly in automotive engineering. As already mentioned above, the corresponding structural members are characterized by particularly high dimensional precision and therefore are particularly good for use in automotive engineering. Due to the simple method and the high natural strains, which can be obtained with the method according to the invention, particularly complex structural members or half shells with high dimensional precision can be made available to automotive engineering as a result. Depending on need and position of installation the flange can be removed from the structural member.

BRIEF DESCRIPTION OF THE DRAWINGS

There are a plurality of possible embodiments of the method according to the invention for the production of converted blanks or the use according to the invention of the blanks converted accordingly. The invention is described below in greater detail on the basis of exemplary embodiments shown in the drawings. The drawing shows in FIG. 1 a perspective illustration of a blank with bulges to be used in accordance with an exemplary embodiment of the method according to the invention, FIGS. 2, 3 schematic plan views onto various bulges of a blank, FIGS. 4 to 7 a schematic cutaway view of a tool in the form of a die during the execution of an exemplary embodiment of the method according to the invention.

DETAILED DESCRIPTION

Figure 1:
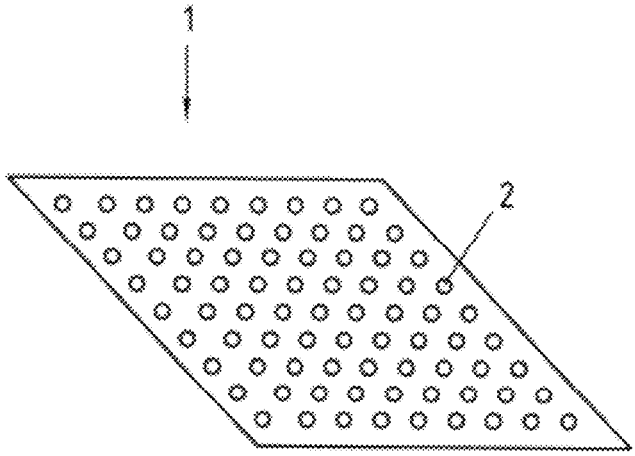
Figure 2:
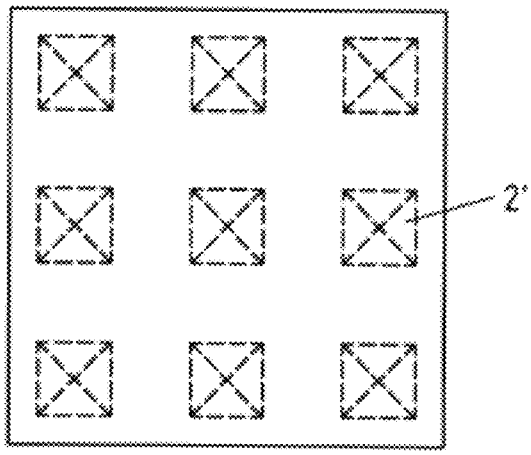
Figure 3:
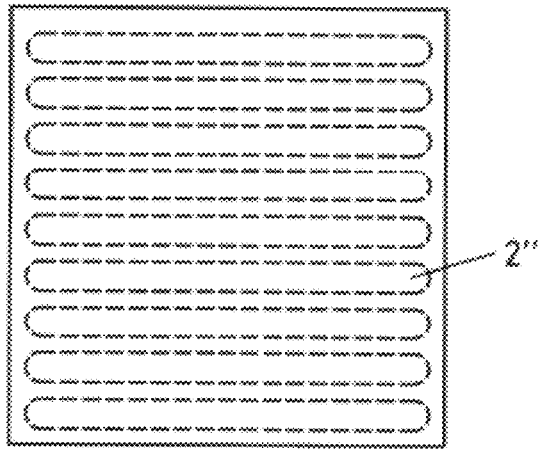

Firstly, FIG. 1 in a perspective view shows a blank 1, which has a plurality of bulges 2. Preferably, the bulges are arranged regularly and, as indicated in FIG. 1, provided with a circular opening surface. However, other bulges can also be provided on the blank, as for example FIGS. 2 and 3 show. FIG. 2 illustrates a cut-out of a blank in a plan view, wherein bulges 2' are provided with a square surface area and a regular arrangement. In FIG. 3 elongated beads 2" are provided as bulges. The bulges serve to provide shaping reserves of the blank, as they must be made available for conversion in a tool according to the invention, in order to produce components with high dimensional precision.

Figure 4:
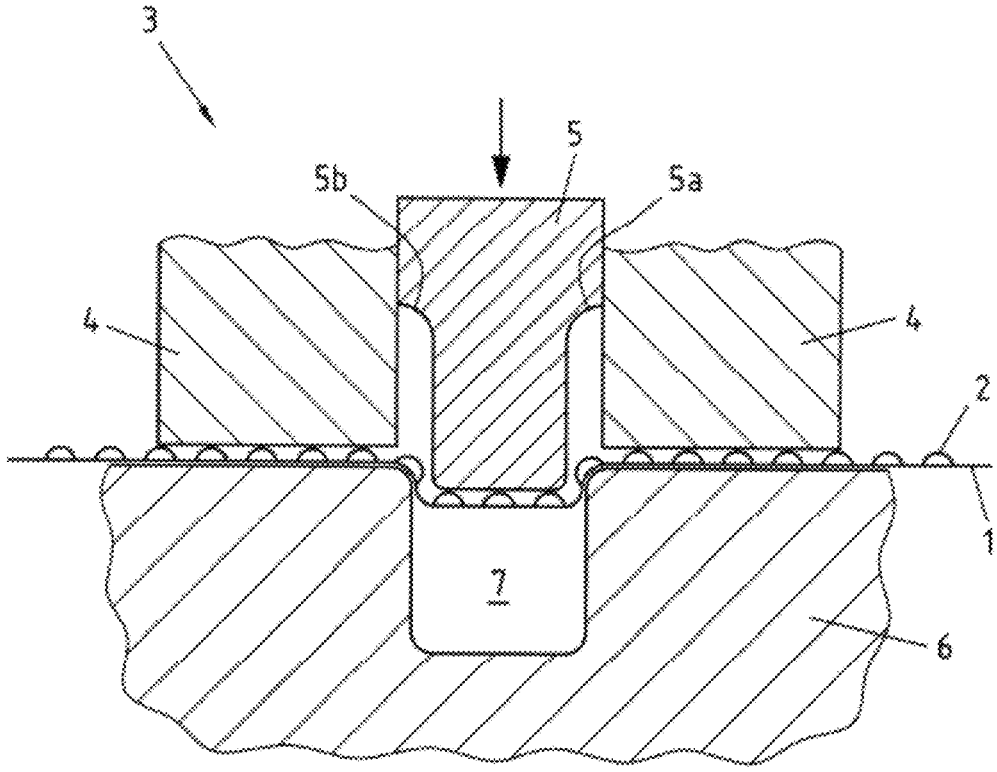

FIG. 4 shows an exemplary embodiment of the method according to the invention in a schematic cutaway view of a die 3 to produce a half shell from a blank by drawing. The die 3 has a pressure pad 4, a ram 5 and a die 6, the blank 1 being drawn into the die 6 using the ram 5. As is evident in FIG. 4, the pressure pad 4, according to the first process step according to the invention, is moved into a position, which corresponds to the height of the bulges added to the blank thickness. In this position the pressure pad 4, via the bulges 2, has contact with the blank 1 and thus holds the blank 1 in position during the first process step.

The ram 5 now converts the blank 1 provided with the bulges 2 in the region of the deepening 7 of the die 6. By moving the ram 5 into the die 6 the bulges in the region of the drawing radius between the later notch of the converted blank 1 and the flange region of the blank 1 held by the pressure pads 4 are maintained or persist, respectively, as FIG. 5 shows.

Figure 5:
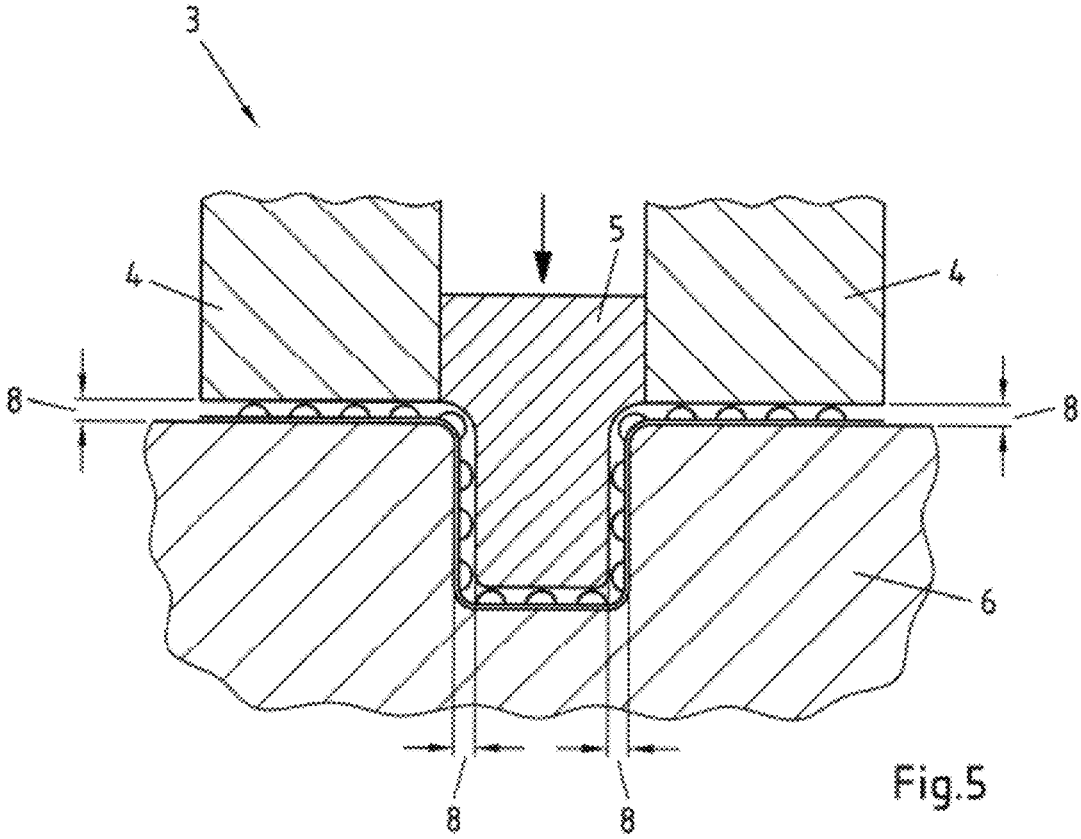

FIG. 5 illustrates the end of the first process step of the exemplary embodiment of the method according to the invention. By selecting the position of the pressure pads 4 and by providing a drawing gap 8, which is greater than or equal to the height of the bulges added to the blank thickness, it is ensured that the material reserves for aligning the stresses as a result of the bulges to a large degree remain up to the end of preforming.

Figure 6:
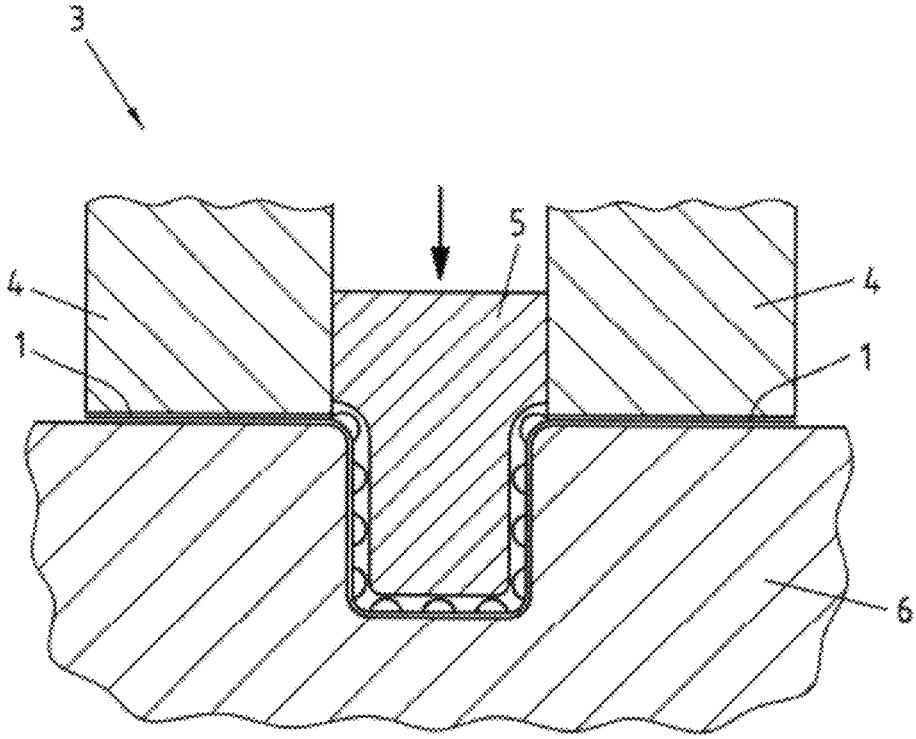

Complete squeezing out of the bulges in the region of the pressure pad 4, that is to say in the region of the flange of the half shell, is achieved by driving down further the pressure pad, as can be seen in FIG. 6.

Figure 7:
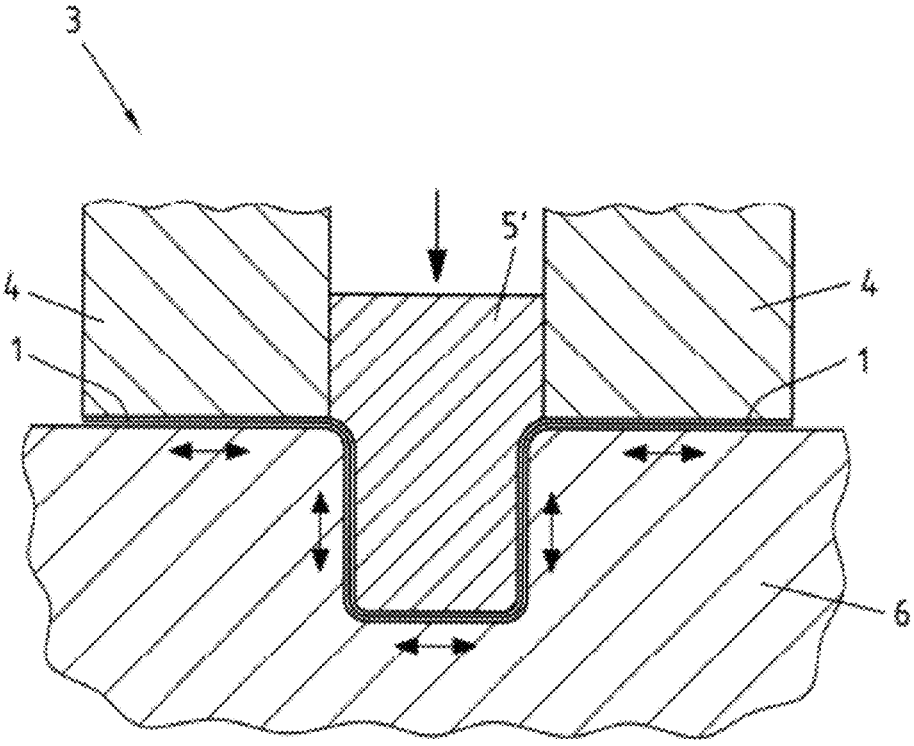

FIG. 7 shows the die 3 from FIG. 4 at the end of the second process step in the embodiment with a one-piece ram. In the case of vertical notches, as in the exemplary embodiment described here, during preforming or predrawing the gap can also be obtained, for example, by a telescopic ram structure similar to the ram 5'. Preferably, this has initially a corresponding large gap 8. Finally, the gap is eliminated by lowering the telescopically enclosing finish ram. However, conversion to the end form of the half shell can be achieved by a ram, which for example has extendable embossing elements, with which the ram converts the blank to the end form. It is therefore not absolutely necessary to replace the ram in the second process step. Rams of this type are not illustrated in the figures.

The ram 5' also has extensions 5*a* and 5*b*, which convert or shape the region of the drawing radius between notch and flange region. In the present exemplary embodiment of the method according to the invention, compression is achieved over the entire cross section of the component by the bulges being completely squeezed out of the blank 1 or smoothed at the end of the second process step. The converted blank, that is to say the present half shell, therefore has particularly high dimensional precision, since stresses induced due to compression over the entire cross-sectional area can be essentially completely reduced and specifically aligned, so that almost no springback occurs. At the same time, the method according to the invention combines this advantage with the provision of very large natural strains, which are advantageous particularly when blanks made of high or maximum strength steel are used.

The invention claimed is:

1. Method for converting blanks by drawing in a tool with a ram, a mould and a pressure pad, wherein a blank with a plurality of bulges is fed to a tool, in flange regions of the blank the pressure pad is moved in a first process step into a first position which corresponds to the maximum height of the bulges of the flange region of the blank added to the blank thickness, the pressure pad holds the flange regions of the blank down in the first position, in the first process step the blank is preformed in the tool using the ram and in a second process step the pressure pad and the ram are moved into end positions, so that the blank is converted by the ram to an end form and the pressure pad smoothes the bulges of the flange regions of the blank.

2. Method according to claim 1, wherein during the first process step the bulges persist in the preformed blank and in the second process step first the pressure pad and afterwards the ram are moved into the end positions, so that the bulges are smoothed first in the region of the pressure pad and then in a remaining region.

3. Method according to claim 1, wherein the blank consists of steel.

4. Method according to claim 1, wherein in the first process step the bulges are flattened in inlet regions of the ram between flange and a frame of the converted blank.

5. Method according to claim 1, wherein the ram of the tool has an extension towards a drawing radius, which produces the drawing radius on a drawn component in the second process step.

6. Method according to claim 1, wherein in the first process step a gap is created in the region of a frame of the converted blank, which is greater than or equal to the height of the bulges added to the blank thickness.

7. Method according to claim 1, wherein in a final shaping a gap between blank and tool is about zero.

8. Method according to claim 1, wherein a surface of the blank, which is provided with the bulges is 0.1-10% greater than that of an even blank.

9. Method according to claim 1, wherein bulges with a circular, elliptical, multi-angular and/or elongated opening surface are provided.

10. Method according to claim 1, wherein the bulges on the blank are arranged in such a manner that equally distributed, even spacings develop on the blank between the bulges.

* * * * *